United States Patent [19]

Thinesen

[11] Patent Number: 5,063,544

[45] Date of Patent: Nov. 5, 1991

[54] PROGRAM TO ALTER ALARM SETTING IN A MULTIMODE ALARM TIMEPIECE

[75] Inventor: Tom Thinesen, Sunnyvale, Calif.

[73] Assignee: Timex Corporation, Waterbury, Conn.

[21] Appl. No.: 500,327

[22] Filed: Mar. 28, 1990

[51] Int. Cl.[5] ..... G04B 32/02

[52] U.S. Cl. ..... 368/74; 368/72

[58] Field of Search ..... 368/72–74, 368/250–255, 256–265

[56] References Cited

U.S. PATENT DOCUMENTS

| | | | |
|---|---|---|---|
| 4,274,151 | 6/1981 | Kamiwaki | 368/21 |
| 4,301,524 | 11/1981 | Koepp et al. | 368/261 |
| 4,368,989 | 1/1983 | Kawashima | 368/74 |
| 4,912,688 | 3/1990 | Syfert | 368/67 |

*Primary Examiner*—Bernard Roskoski

*Attorney, Agent, or Firm*—William C. Crutcher

[57] ABSTRACT

A multimode electronic timepiece has a display, an audible alarm device, manually actuated switches, and an integrated circuit programmed to provide several operating modes. The modes include a first mode in which an alarm sounding setting is displayed, which is alterable in response to actuation of a selected setting switch. The modes include a second mode in which said alarm sounding setting is not displayed, but in which said audible alarm device may be disabled by actuation of a selected disabling switch. The improvement consists of a display of the alarm setting which pops up when the alarm sounds and allows the user to reset or restart the timing cycle within a preselected time by actuation of at least one selected switch. A timer causes the pop-up display to disappear without alteration of the alarm setting if the switch is not actuated within the preselected time.

5 Claims, 7 Drawing Sheets

PROGRAM TO ALTER ALARM SETTING IN A MULTIMODE ALARM TIMEPIECE

BACKGROUND OF THE INVENTION

This invention relates generally to multimode electronic timepieces having audible alarms. More particularly, the invention relates to an improved program for altering an alarm sounding setting displayed in a first mode when the timepiece is currently displaying a second mode.

Multimode, multifunction wristwatches (or wrist instruments) are known which include a display, a lamp for illuminating the display, a number of manually actuated switches and an integrated circuit programmed in a preselected sequence. Examples of such watches are seen in U.S. Pat. No. 4,783,773—Houlihan et al, U.S. Pat. No. 4,780,864—Houlihan and U.S. Pat. No. 4,283,784—Horan, all of the foregoing being assigned to the present assignee. In the foregoing patents, which are merely exemplary of multimode electronic wrist instruments or multifunction wristwatches, one of the manual actuators may typically serve to repetitively cycle the instrument through a number of modes or operating states in each of which a different type of information is displayed. Such modes may include, in a multifunction watch, the time of day, chronograph, dual time zone, elapsed time and an alarm setting mode. By special preselected actuation of one of the switches, the wristwatch may be further converted into a computer, a speedometer, pulsometer or any other type of device, subject only to the imagination of the designer and programmer of the integrated circuit. While in any of these modes, another manual switch actuator may be employed to change the information being displayed in that mode or state, such as initiating the chronograph timing or setting the time-of-day or setting the alarm time or performing a calculation.

A problem existing in multimode electronic timepieces with audible alarms is that very often the audible alarm will sound when the timepiece is operating in a different mode. For example, a multimode electronic wristwatch often has an alarm setting mode, in which a desired alarm time is set by manually actuating one or more switches or pushbuttons to set a desired time for the audible alarm to sound. The time of the alarm setting is displayed while in the alarm setting mode. Also, there is commonly a provision for "arming" or "disarming" the alarm while in the alarm setting mode. However, when the alarm sounds, the watch may be displaying current time in the time of day mode. The user may wish to disable the alarm or to reset it to new time. In order to do this, it is necessary to sequence the watch through the various available operating modes to the alarm setting mode, then to either disable or to reset the alarm, and then to sequence the watch back to the time of day mode, or whatever mode the watch was displaying when the alarm sounded.

The same problem exists in the case of an elapsed time mode where an elapsed time is set by manually actuating one or more switches so that the alarm control device will cause an audible alarm to sound after the elapsed time has counted down to zero. However, when the alarm sounds, the watch may be operating in a different mode. If it is desired to reset the elapsed time or to alter the elapsed time, it is necessary to exit the mode in which the watch is operating, sequence through the various modes to perform the necessary alterations, and then to reenter the current operating mode.

Accordingly, one object of the present invention is to provide an improved program for altering the alarm setting in a multimode alarm timepiece.

Another object of the invention is to provide an improved method for automatically leaving the current mode to the mode displaying the alarm sounding setting so as to permit an alteration in the alarm sounding setting and then returning to the previous operating mode.

SUMMARY OF THE INVENTION

Briefly stated, the invention comprises an improvement in a multimode electronic timepiece having a display, an audible alarm device, a group of manually actuated switches, and an integrated circuit programmed to provide a plurality of watch operating modes. The modes include a first mode in which an alarm sounding setting is displayed, the alarm sounding setting being alterable in response to actuation of selected switches. The modes include a second mode in which the alarm sounding setting is not displayed, but in which the audible alarm device may be disabled by actuation of a selected disabling switch. Alarm control means are responsive to the alarm sounding setting for initiating sound from said audible alarm device and for terminating sound by actuation of said selected disabling switch. The improvement comprises pop-up mode means responsive to the alarm control means when the timepiece is in the second mode for causing the timepiece to display said alarm sounding setting in the first mode, means for altering said alarm sounding setting within a preselected time by actuation of at least one selected setting switch, and timer means for causing the timepiece to return to the second mode after said preselected time with an unaltered alarm sounding setting if the selected setting switch has not been actuated within said preselected time.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
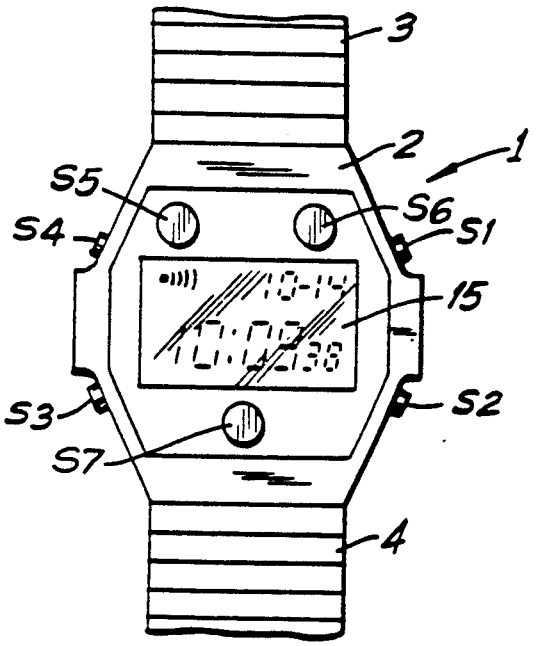
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes seven manual pushbutton actuators S1, S2, S3, S4, S5, S6, and S7 arranged to close spring contacts (not shown) inside the watch case 2. An electroptic display 15, which is commonly a liquid crystal display (or LCD) displays digits, letters or other symbols when activated by a microcomputer inside the watch in the form of an integrated circuit.

Figure 2:
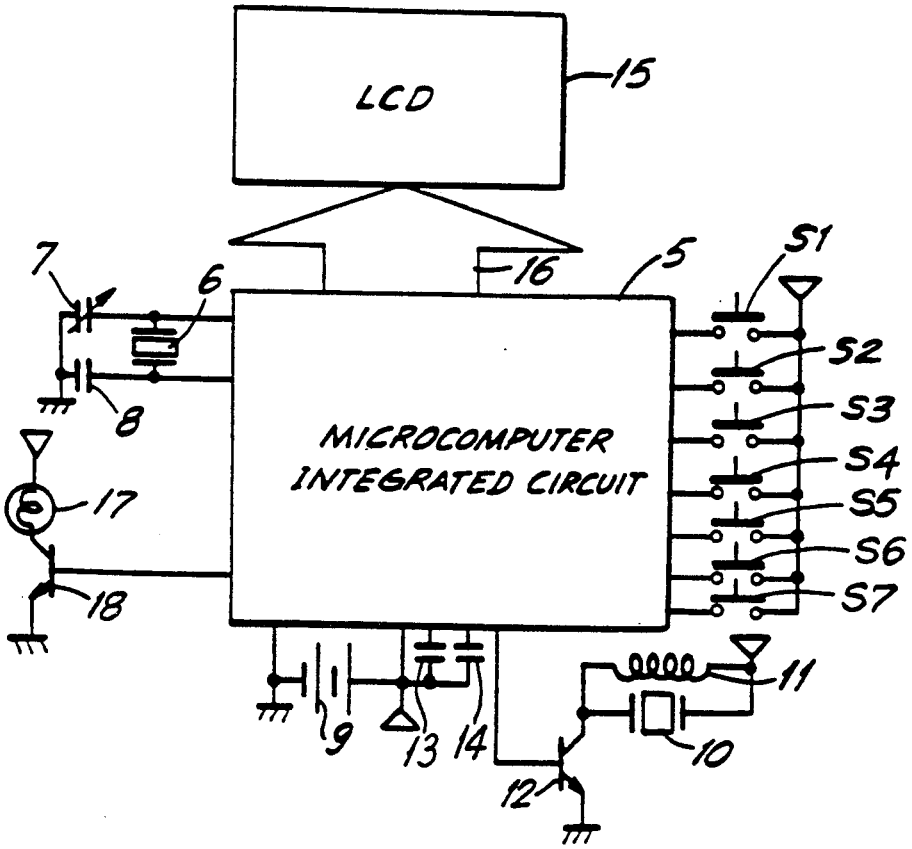
FIG. 2 is a block diagram of a circuit for the wristwatch of FIG. 1, together with external components such as lamp, switches and display.

Referring to FIG. 2 of the drawing, a schematic block diagram of the electrical connections is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor, operating system program for carrying out instructions, and memory locations. A quartz crystal 6 connected in circuit with capacitor 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors 13, 14 combined with other circuit elements combined inside the integrated circuit 5 serve to boost the output voltage to drive LCD 15 through a display bus 16, which represents the several parallel leads connected to the various actuatable segments of the LCD display 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
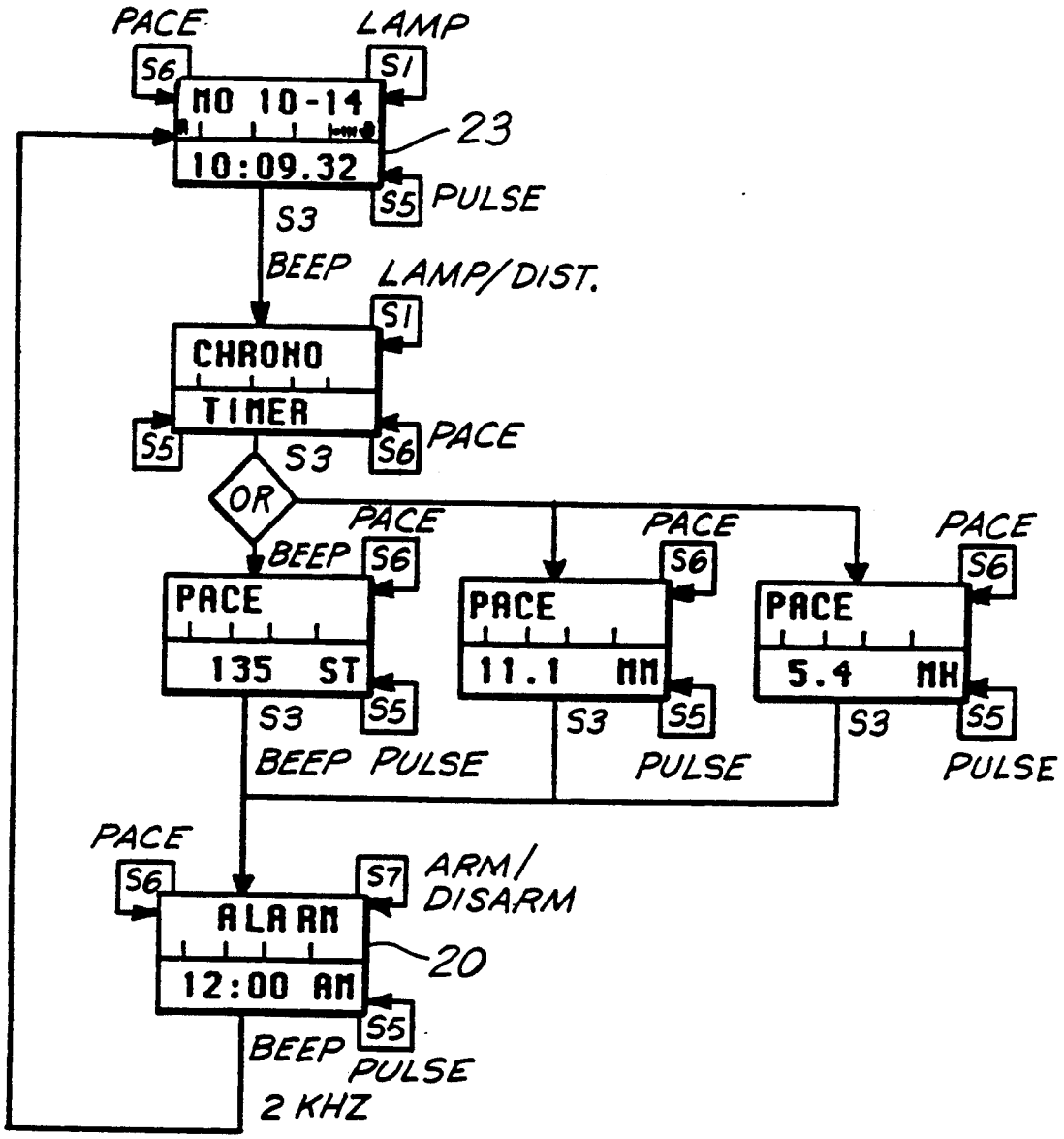
FIG. 3 is a block diagram of a multimode wristwatch illustrating sequence of states in response to manually actuated switches.

Referring now to FIG. 3 of the drawing, a block diagram of a multimode wristwatch illustrates the sequence of modes or states in response to manually actuating switches S1–S7 in accordance with the table. Each of the rectangles illustrates the appearance of the display when entering the modes illustrated. The decision block labeled "OR" represents alternate choices for the "pace" mode display as will be explained.

The following Table 1 shows a complete list of modes for time-of-day mode (TOD) chronograph mode (CHRONO), elapsed time mode (TIMER), pace setting mode (PACE) AND ALARM MODE (ALARM). The first column indicates the manually actuated switches S1 through S7 and columns 2 through 6 show the action taken when the switch is actuated. The last or seventh column (SET) is a setting mode, or routine which is entered from selected modes shown in columns 2, 5 and 6 of Table 1.

| Col. 1 SWITCH | Col. 2 T.O.D. | Col. 3 CHRONO | Col. 4 TIMER | Col. 5 PACE | Col. 6 ALARM | Col. 7 SET |
|---|---|---|---|---|---|---|
| S1 | LAMP | LAMP/DIST | LAMP/DIST | LAMP | LAMP | FWD |
| S2 | PEEK ALARM | STOP/RESET | RESET | PEEK T.O.D. | PEEK T.O.D. | REV |
| S3 | MODE TO CHR/TMR | MODE TO PACE | MODE TO PACE | MODE TO ALARM | MODE TO T.O.D. | SELECT |
| S4 | ENTER SET | SELECT LAP/SPLIT | ENTER SET | ENTER CALIB. | ENTER SET | EXIT SET |
| S5 | PULSE CHECK | PULSE CHCK | PULSE CHECK | PULSE CHECK | PULSE CHECK | REV |
| S6 | PACE ADJST. | PACE ADJST. | PACE ADJST. | PACE ADJST. | PACE ADJST. | FWD |
| S7 | PEEK AT CHRONO | START/ LAP/SPLIT | START/ STOP | SELECT PACE MODE | ARM/ DISARM AL/CHI | SELECT |

In FIGS. 4 through 8 of the drawing, "state" diagrams are shown in schematic form, for alarm time setting, pop-up mode for the alarm, elapsed time setting, elapsed time operation, and pop-up mode for the elapsed time, respectively. One of the rectangles in each figure describes the type of display shown on the electroptical display 15 when the instrument is in that state. The other rectangles in the figure represent various states in which corrections or changes of displayed information may be controlled by the operator. The dotted rectangle indicates which part of the displayed information will be changed when the S1 switch is actuated. The instrument continues to keep time and to operate under control of the particular subroutine of the program in the microcomputer chip until the instrument is placed into another state. Manipulation of the electronic wristwatch to illuminate the display and carry out the various functions and capabilities is by selective actuation of the manually actuated switches S1–S7. The well known programming technique for determining whether the switches are opened or closed and taking appropriate action is through the operating system computer program stored in the microcomputer memory, in which each switch condition is tested during each complete interrogation cycle in a loop. If any switch is closed, the program branches to a subroutine which initiates a counter. The counter determines how long the switch has been closed or, if the watch has entered another "state" how long it has been in that "state".

Figure 4:
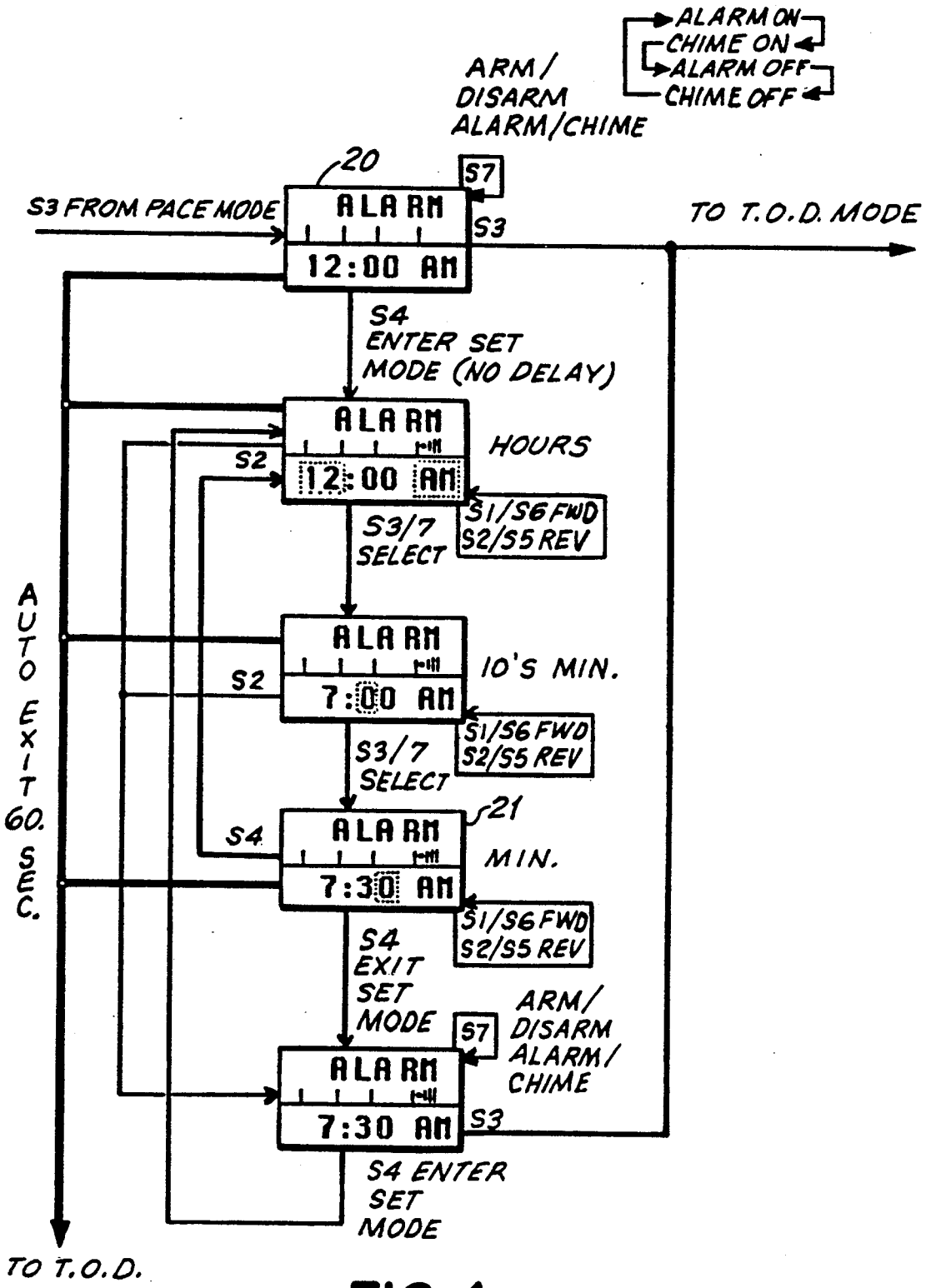
FIG. 4 is a detailed state diagram of an alarm setting routine with means to display and alter an alarm sounding setting.

Reference to FIG. 4 illustrates the ALARM mode in block 20 which displays the setting of a time of day for the audible alarm device to sound. See block 20 also in FIG. 3. The alarm may be armed or disarmed by repetitively operating switch S7.

FIG. 4 also illustrates the SET mode, which is entered by pressing switch S4. While in SET mode, the switches S1 through S7 may be actuated to alter the alarm sounding setting in the manner described. For example, in block 21, the units digit of the alarm sounding setting is flashing and it may be advanced (FWD) by pressing either switch S1 or S6, or moved in reverse (REV) by actuating either switch S2 or S5. The alarm sounding setting is stored in memory and compared periodically with the time of day in a manner well-known to those skilled in the art, so that when the two times coincide as determined by a series of programmed instructions, an output signal actuates the transistor switch 12 (FIG. 2) causing the audible alarm device to sound, providing that the alarm has been enabled or "armed" as described previously. The foregoing alarm mode, alarm setting mode, alarm control means for sounding the alarm and stopping the alarm after a predetermined time are conventional and well-known in the art.

Figure 5:
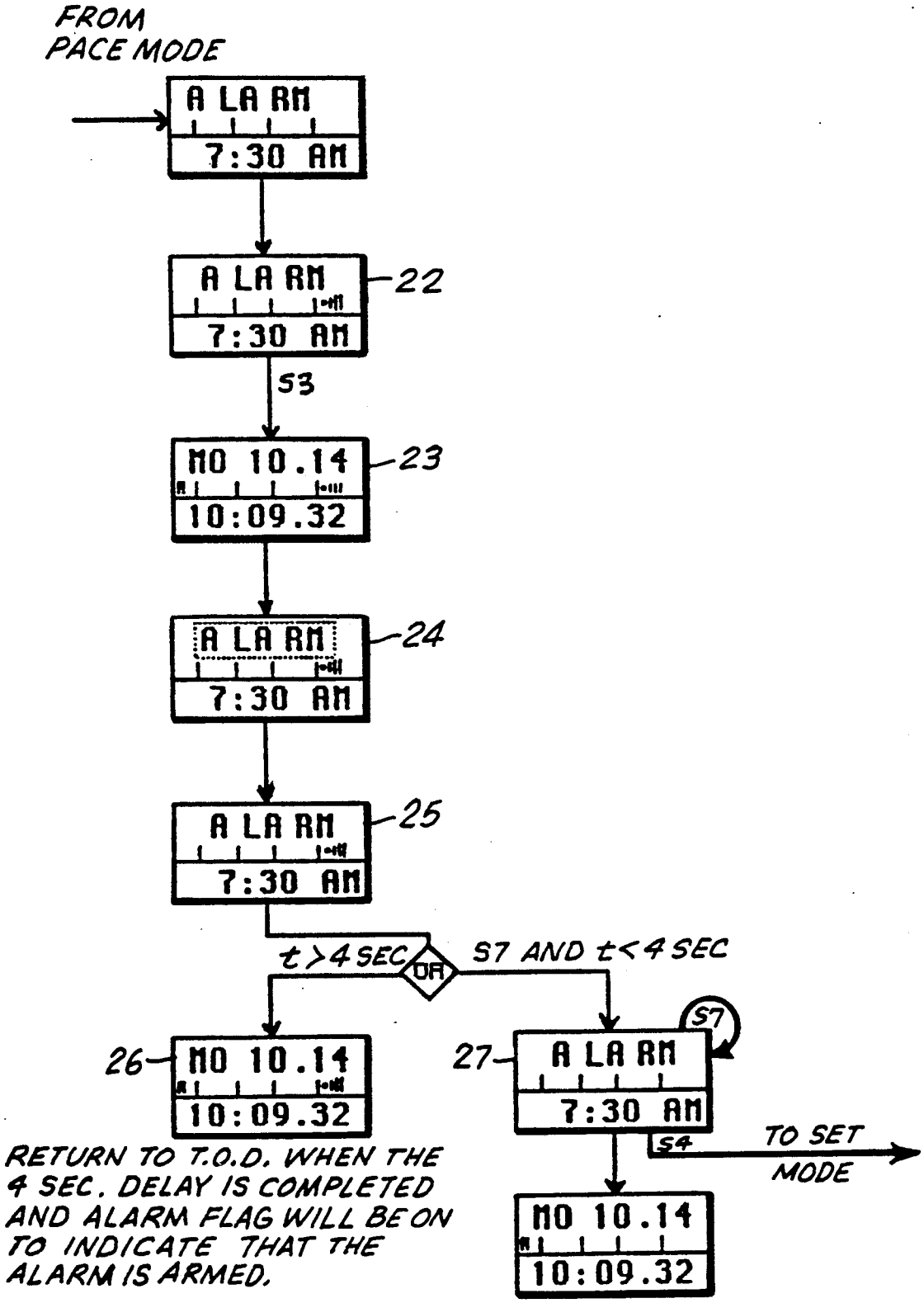
FIG. 5 is a detailed state diagram explaining operation of a pop-up mode routine according to the present invention.

FIG. 5 of the drawing illustrates operation of a pop-up mode routine according to the present invention. In block 22, the alarm is shown set to a selected alarm sounding setting and the alarm has been armed as previously described in connection with FIG. 4. The user returns to the time of day mode depicted in block 23 by pressing switch S3 (FIG. 3). In the time of day mode, the alarm sounding setting is not displayed.

In accordance with the present invention, the operating system program contains instructions to branch to a pop-up mode routine in response to the alarm control means. The pop-up mode routine may be commenced either by coincidence of alarm time setting with time of day which initiates the audible alarm device, or it may be commenced by actuation of a selected disabling switch by the user when the alarm sounds which silences the audible alarm device. The pop-up mode instructions cause the alarm display to appear or pop-up as depicted in block 24 of FIG. 5 with the word "ALARM" flashing. The sound is stopped by pressing a selected disabling switch (any of the switches S1–S7 while the alarm is sounding) or by completing a preselected time period, whereupon the display appears as shown in block 25. If the user takes no action within 4 seconds, the display returns automatically to the time of day mode shown in block 26. However, if the user actuates switch S7 within 4 seconds, the pop-up mode permits alteration of the alarm sounding setting or arming/disarming the alarm by actuation of selected switches as shown in block 27. Toggling of switch S7 arms or disarms the alarm. Actuation of switch S4 causes the timepiece to enter the set mode shown in FIG. 4, whereupon the alarm may be set to a new time. After a predetermined period of time without pressing a switch, the timepiece reverts automatically to the time of day mode.

Figure 6:
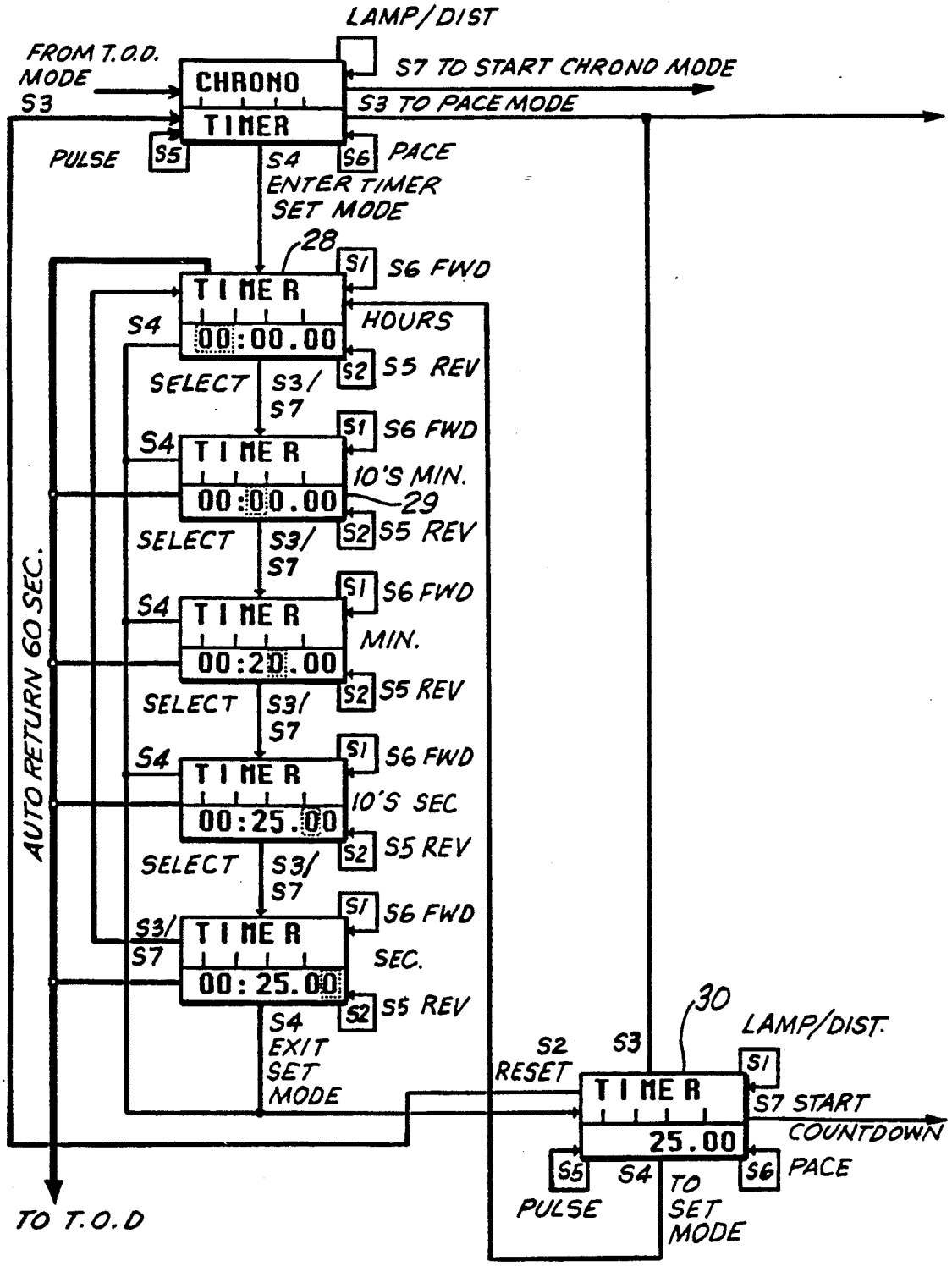
FIG. 6 is a detailed state diagram of an elapsed time setting routine with means to display and alter an alarm sounding setting.
Figure 7:
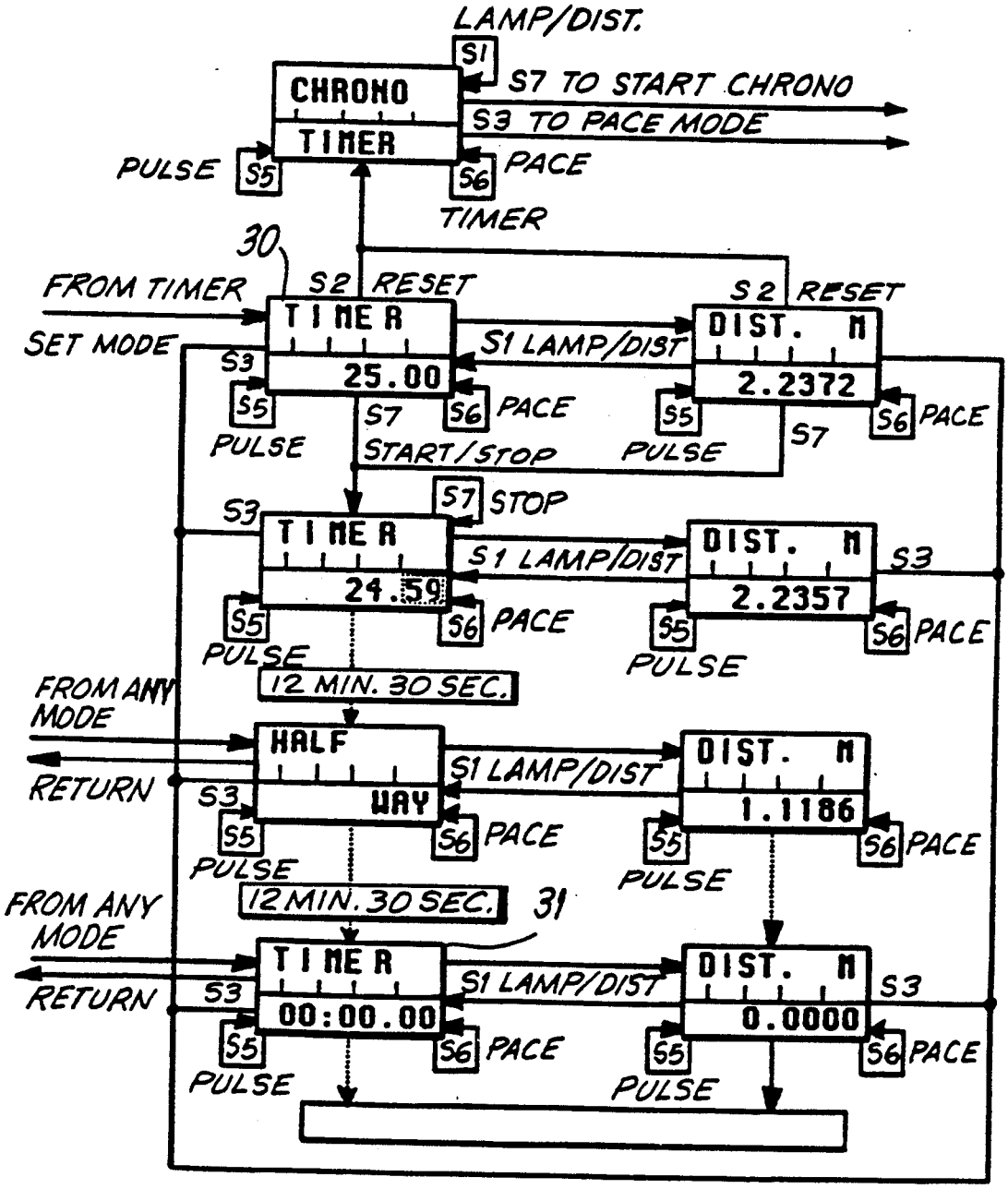
FIG. 7 is a detailed state diagram explaining operation of the timer mode.

FIG. 6 and 7 illustrate another embodiment of the invention, in which the audible alarm device is caused to sound after the elapse of a selected time period known as an elapsed time mode (TIMER) seen in column 4 of table 1. The elapsed time or alarm sounding setting may be set or altered by entering the SET mode. Elapsed time is set by actuation of a selected setting switch commencing with block 28 of FIG. 6 and proceeding to select the desired countdown time. For example, in block 29, the "10" minutes digit is flashing and may be forwarded or advanced (FWD) by pressing switch S1 or S6, or conversely retarded or reversed (REV) by pressing switch S2 or S5. After setting, the TIMER mode is re-entered, where the display appears in block 30.

FIG. 7 illustrates the timer operating mode when countdown starts. The countdown time is displayed in block 30. The countdown is commenced by pressing switch S7. After commencing the countdown, the watch may be used to display some other mode such as time of day or pace mode, for example. In this alternate mode, the alarm sounding setting for the elapsed time is not displayed. Should the audible alarm device sound in response to the alarm control means, while in the alternate mode the audible alarm device may be silenced by actuation of a selected disabling switch (any of switches S1–S7 while the alarm is sounding). At the conclusion of the elapsed time as shown in block 31, the alarm control means activates the audible alarm device and also initiates the elapsed time pop-up mode routine. Of course, the pop-up mode routine could be initiated by the user silencing the audible alarm device. This is purely a matter of choice.

Figure 8:
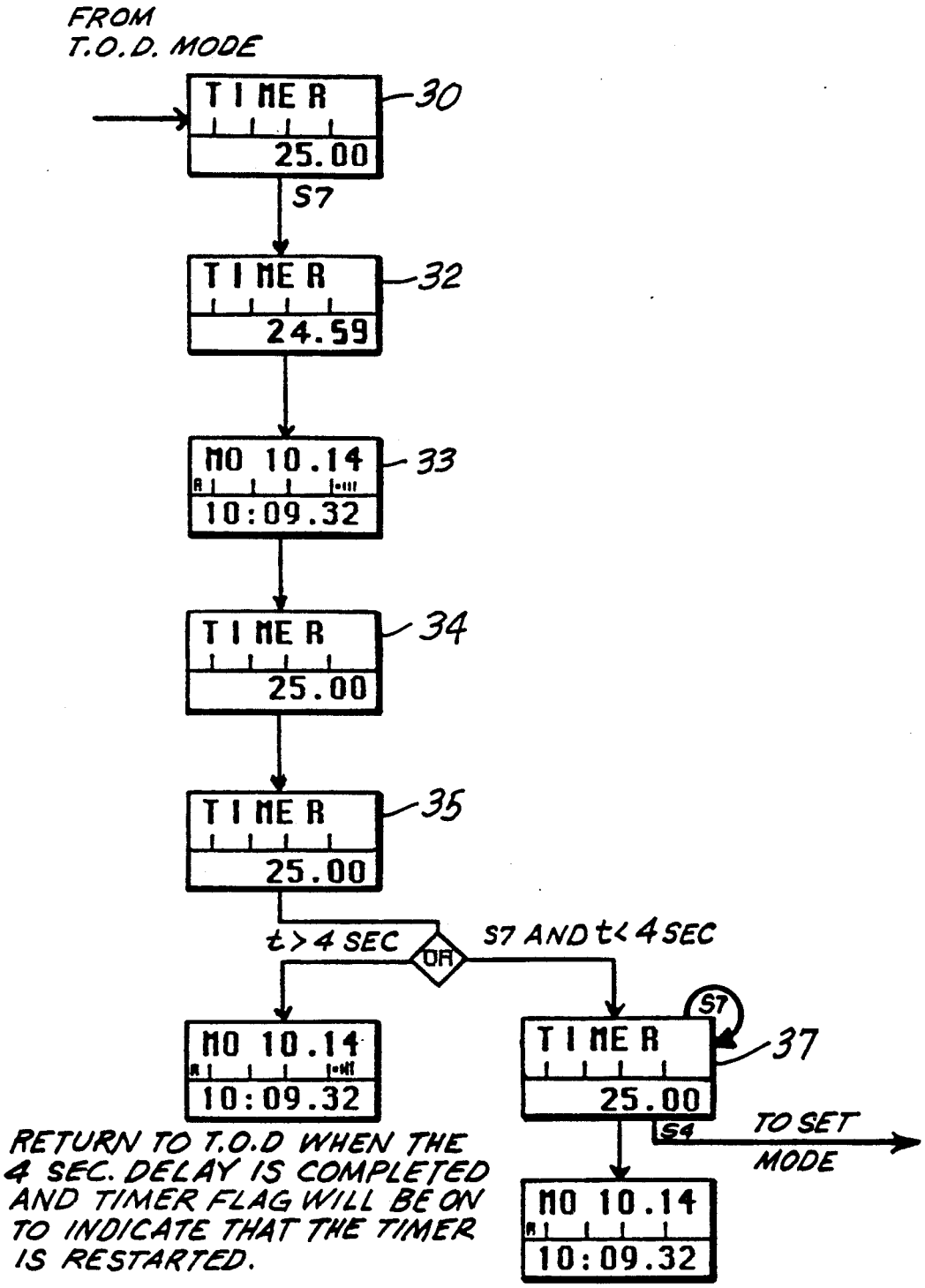
FIG. 8 is a detailed state diagram explaining operation of a pop-up mode routine for the elapsed time.

FIG. 8 illustrates the pop-up mode operation for the elapsed time (TIMER) function. It is comparable to FIG. 5. The timer is shown set at an elapsed time for countdown as indicated in block 30 (See also FIG. 7.) and commences display of countdown of elapsed time as shown in block 32. Any other mode, such as time of day, may be entered after starting the timer as indicated in block 33.

In accordance with the present invention, when the elapsed time has been completed, (block 31 in FIG. 7) the alarm control means will be active. In addition to sounding the alarm, the alarm control means will cause the program to branch to the pop-up mode routine. In this case, rather than automatically displaying the other mode, the program awaits closure of a selected disabling switch to silence the alarm, whereupon the pop-up mode routine also executes an instruction or command which causes the timer display to appear as shown in block 34 indicating the current elapsed time setting. The sound will cease after a 10 second cycle is completed.

The display automatically returns to the time of day mode (or other mode from which the pop-up mode was initiated) after a time period of 4 seconds. However, if S7 is pressed within 4 seconds, the program continues to display the timer mode as indicated in block 37. In this mode, actuation of switch S7 will restart the timer. Actuation of switch S4 will cause the timepiece to enter the set mode for the timer previously shown in FIG. 6. This permits the elapsed time to be set to a new time for an alarm sounding setting.

While the pop-up mode operation has been illustrated and described in connection with an alarm, as well as with an elapsed time or timer mode, other modifications are possible. Initiation of the pop-up mode routine may either be commenced by the alarm control means when it starts the audible alarm device or when the alarm control means terminates the audible alarm device by a user actuating a switch. The pop-up mode permits either arming or disarming an alarm, starting a new countdown period, or changing the set time at which the alarm or elapsed time initiates an audible alarm device.

Alarm sounding setting is construed broadly herein as meaning arm/disarm setting, alarm time setting or elapsed time setting.

While there has been described what is considered to be the preferred embodiment of the invention, other modifications will occur to those skilled in the art, and it is desired to secure in the appended claims all such modifications as fall within the true spirit and scope of the invention.

I claim:

1. In a multimode electronic timepiece having a display, an audible alarm device, a plurality of manually actuated switches, and an integrated circuit programmed to provide a plurality of modes including a first mode in which an alarm sounding setting is displayed, said alarm sounding setting being alterable in response to actuation of a selected setting switch, and a second mode in which said alarm sounding setting is not displayed, but in which said audible alarm device may be disabled by actuation of a selected disabling switch, and alarm control means responsive to said alarm sounding setting for initiating sound from said audible alarm device and for terminating sound by a first actuation of said selected disabling switch when the audible alarm device is active, the improvement comprising:

pop-up mode means responsive to said alarm control means when the timepiece is in said second mode for causing the timepiece to change to said first mode and to display said alarm sounding setting in said first mode, means for altering said alarm sounding setting within a preselected time while in said first mode by actuation of said selected setting switch, and timer means for causing the timepiece to return to said second mode after said preselected time with an unaltered alarm sounding setting if said selected setting switch has not been actuated within said preselected time.

2. The improvement according to claim 1, when said pop-up mode means is initiated at the same time that said alarm control means initiates sound from said audible sound device.

3. The improvement according to claim 1, wherein said pop-up mode means is initiated by actuation of said selected disabling switch at the same time that said disabling switch silences the audible alarm device.

4. The improvement according to claim 1, wherein said first mode is an elapsed time mode and wherein said alarm sounding setting is a desired countdown time to be reached before sounding the audible alarm device.

5. The improvement according to claim 1, wherein said first mode is an alarm setting mode, and wherein said alarm sounding setting is a desired time-of-day for sounding the audible alarm device.

* * * * *